US007101235B2

(12) United States Patent
Baldwin

(10) Patent No.: US 7,101,235 B2
(45) Date of Patent: Sep. 5, 2006

(54) AIR-BOAT SOUND SUPPRESSOR AND DIRECTIONAL CONTROL SYSTEM

(76) Inventor: Charles Baldwin, 1208 12th La., Palm Beach Gardens, FL (US) 33410

( * ) Notice: Subject to any disclaimer, the term of this patent is extended or adjusted under 35 U.S.C. 154(b) by 0 days.

(21) Appl. No.: 10/899,797

(22) Filed: Jul. 26, 2004

(65) Prior Publication Data

US 2006/0019556 A1 Jan. 26, 2006

(51) Int. Cl.
*B63H 7/00* (2006.01)

(52) U.S. Cl. ..... 440/37

(58) Field of Classification Search ..... 440/37
See application file for complete search history.

(56) References Cited

U.S. PATENT DOCUMENTS

| | | | | |
|---|---|---|---|---|
| 2,341,911 | A | | 2/1944 | Drexler et al. |
| 3,398,809 | A | | 8/1968 | Wood et al. |
| 3,608,662 | A | | 9/1971 | Ferguson |
| 3,861,491 | A | | 1/1975 | Ferguson |
| 3,870,121 | A | | 3/1975 | Schneider |
| 4,005,673 | A | | 2/1977 | Carrero |
| 4,015,555 | A | | 4/1977 | Tinkham |
| 4,046,215 | A | | 9/1977 | Hietanen et al. |
| 4,165,701 | A | * | 8/1979 | Kluytmans ..... 114/61.21 |
| 4,407,215 | A | | 10/1983 | Cyr |
| 4,421,489 | A | | 12/1983 | Van Veldhuizen |
| 4,509,899 | A | | 4/1985 | Frederick |
| 4,865,275 | A | | 9/1989 | Thompson |
| 4,962,718 | A | * | 10/1990 | Gornstein et al. ..... 114/274 |
| 4,998,898 | A | | 3/1991 | Dufrene |
| 5,016,553 | A | | 5/1991 | Spencer |
| 5,082,465 | A | | 1/1992 | Wine |
| 5,161,752 | A | | 11/1992 | Cockerham et al. |
| 5,522,470 | A | * | 6/1996 | Stiegler et al. ..... 180/117 |
| 5,615,834 | A | | 4/1997 | Osman |
| 5,839,926 | A | | 11/1998 | Kaye |
| D427,562 | S | | 7/2000 | Phelan |
| 6,725,637 | B1 | | 4/2004 | Snider et al. |

* cited by examiner

*Primary Examiner*—Stephen Avila
(74) *Attorney, Agent, or Firm*—McHale & Slavin

(57) ABSTRACT

The instant invention relates to a sound suppressor and directional control system for use with a boat hull propelled by a rearward directed jet of air, e.g. an air-boat. The device includes a propeller shroud and a aft fairing each having a layer of acoustic material to reduce sound generated by the rotating propeller. The construction of the device also provides increased maneuverability, stopping and reverse to pre-existing as well new air-boats by providing operator controlled vector thrusts.

16 Claims, 7 Drawing Sheets

AIR-BOAT SOUND SUPPRESSOR AND DIRECTIONAL CONTROL SYSTEM

FIELD OF THE INVENTION

This invention relates to a sound suppressor and directional control system for an air-boat; particularly to a propeller shroud including an aft fairing. In one embodiment the aft includes clamshell doors and actuators for reversing and/or redirecting the direction of the rearward air jet generated by the propeller.

BACKGROUND OF THE INVENTION

Propeller driven boats, or "air-boats" as they are commonly known, have found wide application and acceptance in areas where shallow water, reeds, everglades, partially frozen lakes and sub-surface debris present hazards to the operation of a submersed propeller. A significant advantage associated with air-boats is their ability to skim over the surface of land or water alike at high speeds, having relatively little impact on whatever lies beneath it.

An air-boat operates on the principle that once the propeller generates a rearward jet of air sufficient to overcome the friction encountered by the boat hull, the hull of the boat planes over the surface. Developing a sufficient rearward jet of air necessary to plane on land or hydroplane on water requires a significant amount of power, depending on the size and weight or the boat.

Typically, an air-boat is powered by an aircraft or automotive internal combustion engine. Aircraft engines normally include a propeller directly coupled to the crankshaft of the engine and thus are generally mounted high above the water line of the boat hull to provide adequate clearance for the rotating propeller. Automotive engines are mounted lower to the waterline and typically require a crankshaft speed reducer mounted between the engine and the propeller. The speed reducer allows the propeller to be mounted sufficiently high above the water line to provide the clearance needed for rotation.

The typical propeller used in air-boats is a two blade aircraft propeller. When the propeller is rotating at maximum speed, each of the propeller tips generate shock waves which produce a significant amount of noise. The noise generated by the propeller often limits air-boat operation to secluded areas. U.S. Pat. No. 5,839,926 teaches a system for mounting two counter-rotating propellers on a single engine for reducing the noise generated by an air-boat. While this system does provide some sound reduction, the increased complexity and cost associated with installation and maintenance deters widespread use of the system.

Air-boat propellers are usually protected by an open wire mesh cage that serves to protect boaters and fowl from the dangers associated with a rotating propeller. U.S. Pat. No. D427,562 illustrates an ornamental design for an air-boat similar to many modern constructions. While the open mesh cages provide some safety they do nothing to reduce the sound generated by the propeller.

Steering of air-boats has typically been accomplished by rudders of either the conventional submerged type or the aircraft type mounted in the slipstream of the propeller. The operation of submerged rudders may be objectionable because any submerged movable part is subject to hazards such as sub-surface debris, rocks, etc. The use of a slipstream-mounted rudder is disclosed in U.S. Pat. No. 4,015,555. The use of such rudders can be disadvantageous since they are inefficient and are characterized by sluggish response because they are dependent upon the deflection of the rearward air jet. The rearward jet of air required to turn the boat produces a substantial amount of forward thrust making navigation in cluttered areas extremely difficult or impossible with this type of construction.

An alternative method of steering an air-boat is disclosed in U.S. Pat. No. 4,005,673. This method consists of changing the direction of thrust by turning both engine and propeller together about a vertical axis. This method also has undesirable characteristics. First, turning both the propeller and engine as a unit requires substantial structural mounts to avoid instability. Second, this method has the additional disadvantage of offering no inherent self-centering characteristics. Once turned, the gyroscopic effect generated by the propeller will continue to turn the boat until such time as the operator returns the mechanism to a centered position. Third, sharp turns create the danger of moving a portion of the propeller into close proximity with passengers in the boat.

Yet another method of steering an air-boat consists of an engine coupled, via a combination of shafts and gears to a pivoting propeller support structure, as shown in U.S. Pat. No. 2,341,911. This design is disadvantageous due to its inherent complexity and because the vertical drive shaft coupling the engine and propeller may tend to induce rotation in the pivoting propeller support structure.

In general, air-boats of the prior art suffer from the same drawbacks. The primary drawback is the noise generated by the propeller. The noise substantially limits the areas where air-boats may be operated. Another drawback relating to prior art air-boats results from a general lack of controllability. A direct coupling between the engine and the propeller causes the propeller to rotate whenever the engine is running and stop when the engine stops. The direct coupling makes engine idling without forward motion difficult due to the continued air thrust being produced. The continuous thrust also limits an air-boats ability to stop or quickly slow down in emergency situations. Air-boats can be difficult to control when there is a loss of engine power which stops or reduces the slipstream of air produced by the propeller. After engine loss or failure the air-boat will generally become uncontrollable. Without the slipstream of air or a rudder extending into the water there is generally no means to turn or stop the boat. This may create extremely dangerous situations in the event that an obstruction is in the boats path.

Other known specialized air propelled vehicles include for example, U.S. Pat. No. 4,421,489 which teaches a ground effect vehicle propelled by a rearward discharge of fluid therefrom. The device includes a pair of upstanding steering vanes mounted for rotation about upstanding axes and disposed on opposite sides of the center line of the fluid path. Control structure is provided to simultaneously angularly displace the vanes about their axes of oscillation. The vanes extend rearwardly of their axes of oscillation so that opposite relative angular displacement of the vanes will cause the rear ends of the vanes to swing into close juxtaposed positions. Disadvantages of this construction include complexity of the mechanisms required to independently and accurately control the steering vanes. In addition, this construction does not provide any means for slowing down or steering the boat in the event that engine power is lost.

U.S. Pat. No. 6,725,637 teaches an air-boat for reducing aquatic plant infestation by mulching or otherwise chopping plants growing on the surface of the water as the craft moves forward along a waterway. The air-boat includes a hull with an intake port at the bow end of the craft.

While the foregoing described prior art devices have improved the art and in some instances enjoyed commercial success, there remains nonetheless a continuing need in the art for evermore improved air-boat constructions for broadening the capabilities and increasing the overall safety of air-boating.

Therefore what is needed in the art is a directional control system of the vector thrust type which may be utilized in conjunction with an air-boat which will enable the air-boat to be precisely maneuvered, braked and operated in reverse. The directional control system should be adaptable to pre-existing as well as new air-boats. The directional control system should provide increased turning and stopping abilities when compared to the prior art. The directional control system should also suppress a substantial portion of the sound generated by a rotating propeller to allow air-boat use in residential or cluttered areas.

SUMMARY OF THE INVENTION

The foregoing objectives are satisfied by the provision of a sound suppressor and directional control system for use with a boat hull propelled by a rearward directed jet of air, e.g. an air-boat. The construction of the device provides increased maneuverability, stopping and reverse to pre-existing as well new air-boats by providing operator controlled vector thrusts.

The directional control system of the present invention deals not only with maneuvering, stopping and reverse thrust performance, but also with suppression of the sound generated by a rotating propeller. The system deals with these performance issues in a superior manner by combining a sound suppressing shroud for the rotating propeller and an aft fairing. The shroud and the aft fairing have a central longitudinal axis which falls in a vertical plane and which axis, if extended, would pass through the longitudinal centerline of the hull. The propeller shroud fully encircles the propeller and includes a forward converging lip having an air inlet aperture smaller in diameter than the propeller. The aft fairing attaches to or may be integrally formed with the shroud and is constructed substantially hollow having an outer visible surface and an inner surface converging to an exhaust aperture for discharging the jet of air, generated by the propeller, in a rearward direction. Between the outer and inner surface is preferably a layer of acoustic material for absorbing sound generated by the propeller. The combination of the shroud and aft fairing suppress the noise normally output from propeller driven devices.

In alternative embodiments the aft fairing includes operator controlled clamshell doors on either side of the central longitudinal axis. Linkage and/or actuators are secured between the aft fairing and the clamshell doors for allowing the air-boat operator to control the operation of clamshell doors throughout their range of motion. The actuators and linkage attach between the aft fairing and the clamshell doors allowing the air-boat operator to control movement of the doors between their stowed positions, directing the rearward jet of air through the exhaust aperture, and a range of deployed positions, for reversing or diverting the jet of air perpendicular to the longitudinal centerline of the boat for improved turning and/or stopping. The clamshell doors are constructed for selective independent, as well as similar simultaneous movement, for increased operator control throughout the range of the clamshell door motion.

At least one, and preferably two, steering vanes are each mounted within the aft fairing for pivotal movement about a generally vertical axis and are positioned within the rearward jet of air. The propeller shroud and the aft fairing concentrate and direct the rearward jet of air through the exhaust aperture and pivotal movement of the steering vanes cause deflection of the air for directional movement of the boat hull in a typical manner. In one embodiment, the steering vanes are constructed and arranged to pivot about 180° wherein they may be selectively positioned substantially perpendicular to the longitudinal centerline of the boat to substantially cover the exhaust aperture if desired. Blocking the exhaust aperture substantially reduces rearward thrust and allows the jet of air to be diverted through one or both of the clamshell doors for operator controlled vector thrusts. By utilizing the aforementioned system, an air-boats ability to be maneuvered, stopped or turned is substantially increased, and sound produced by the rotating propeller is substantially reduced.

In a further alternative embodiment the air inlet aperture includes a baffle having the same general shape as the air inlet aperture. The baffle is supported by the shroud so that the forward portion of the baffle extends in front of the air inlet and the rearward portion extends into the air inlet. In this manner the baffle directs air into the air inlet and retains sound within the shroud.

Accordingly, a primary objective of the instant invention is to teach a substantially improved directional control system that overcomes the limitations of conventional air-boat steering systems.

Another objective of the instant invention is to teach a device for reversing and/or redirecting the direction of the rearward air jet generated by the propeller of an air-boat.

Yet another objective of the instant invention is to teach a device which will enable an air-boat to be precisely maneuvered, braked and operated in reverse.

Still another objective of the instant invention is to teach a directional control system for an air-boat that is adaptable to pre-existing, as well as, new air-boat constructions.

Still yet another objective of the instant invention is to teach a sound suppressor for an air-boat that reduces the sound generated by a rotating propeller.

Other objectives and advantages of this invention will become apparent from the following description taken in conjunction with the accompanying drawings wherein set forth, by way of illustration and example, certain embodiments of this invention.

The drawings constitute a part of this specification and include exemplary embodiments of the present invention and illustrate various objectives and features thereof.

DETAILED DESCRIPTION OF THE PREFERRED EMBODIMENT

Figure 1:
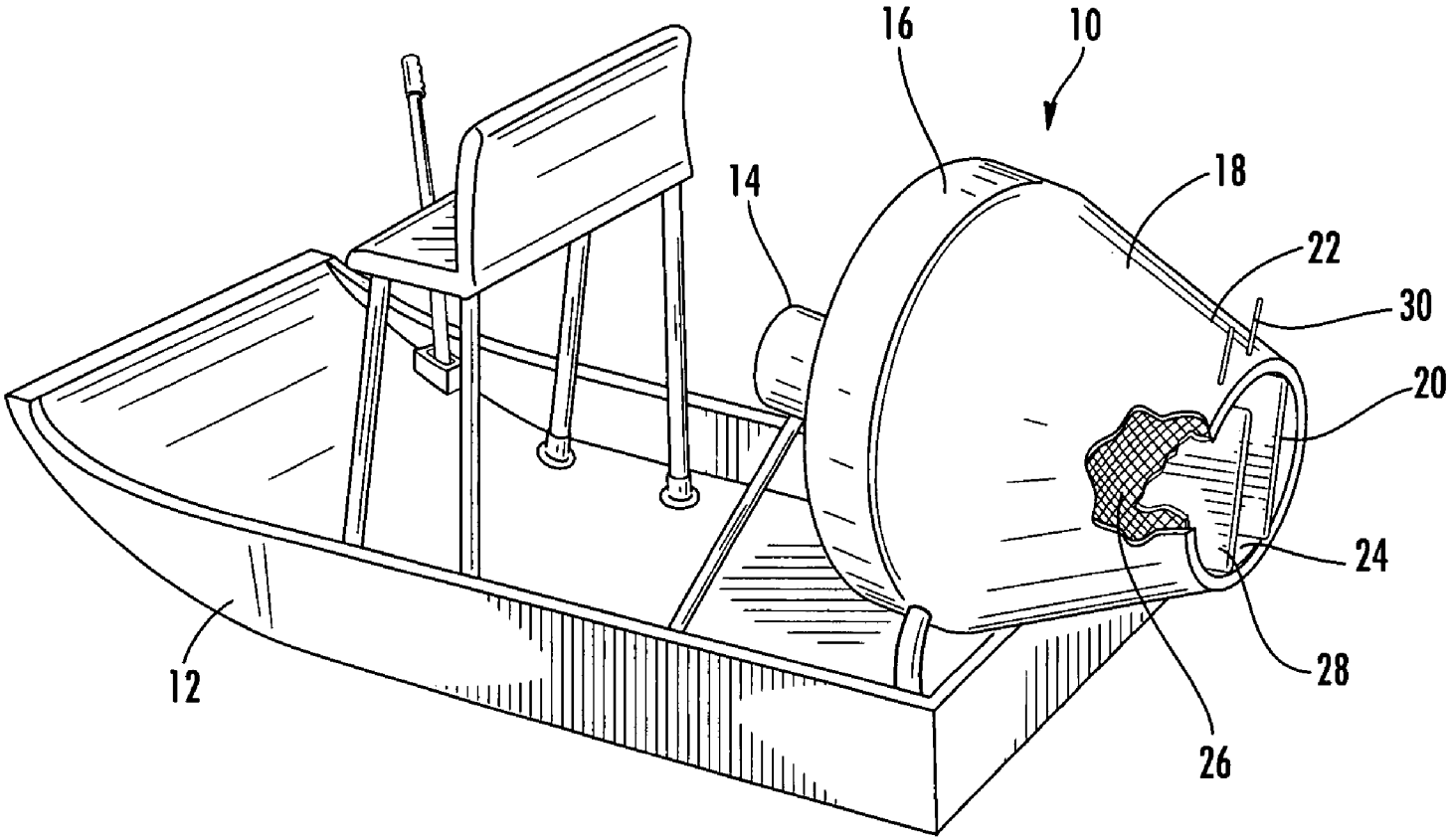
FIG. 1 sets forth a perspective view, partially in section, of an air-boat incorporating the teachings of the instant invention.
Figure 5:
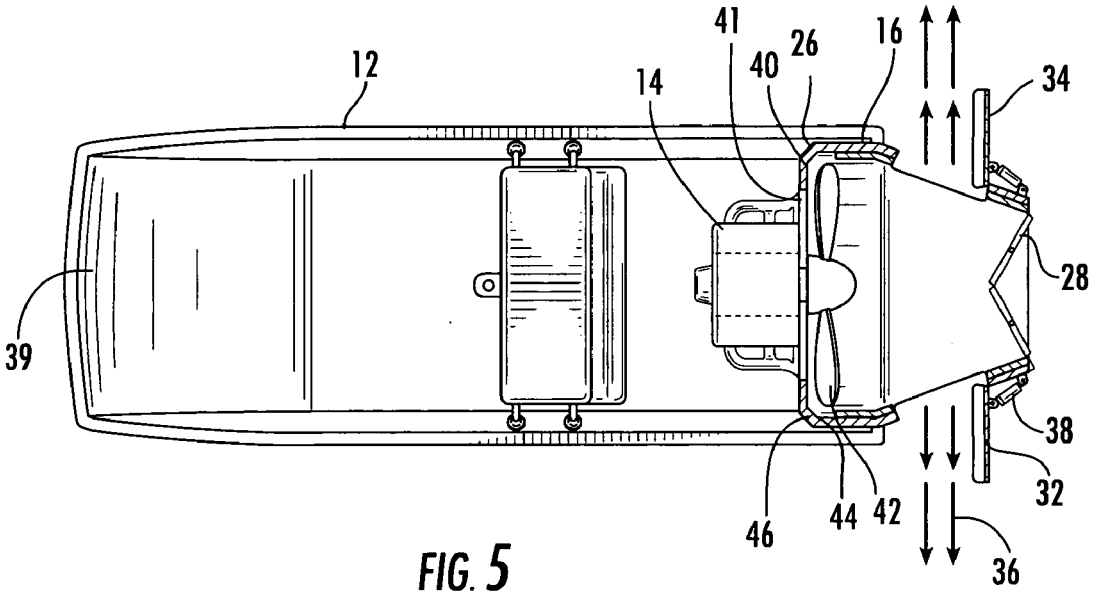
FIG. 5 sets forth a top view of the air-boat shown in FIG. 2, illustrating the clamshell doors in a deployed turning thrust position and the normally rearward jet of air discharging perpendicular to the longitudinal centerline of the air-boat.

Referring to FIG. 1, an air-boat 100 incorporating one embodiment of the sound suppression and directional control system 10 is illustrated. The air-boat 100 generally includes a boat hull 12 to be propelled by a rearwardly discharged jet of air. For generating the rearward jet of air, the air-boat includes an engine 14 and propeller 42 (FIG. 5). In operation, the engine provides rotation to the propeller thereby generating the jet of air that is directed in a rearward direction with respect to the boat hull.

In a first embodiment the sound suppressor and directional control system comprises a propeller shroud 16 fully encircling the propeller 42. The shroud includes a forward fairing 40 (FIG. 3) and an aft fairing 18. The forward fairing 40 converges from the shroud to an inlet opening 41 (FIG. 5). In the preferred embodiment the inlet opening is constructed smaller in diameter than the outermost tips of the rotating propeller 42. The aft fairing 18 includes an outer surface 22 and an inner surface 24. The inner surface converging to an exhaust aperture 20 for discharge of the jet of air in a rearward direction. In a most preferred embodiment there is a layer of sound dampening acoustic material 26 between the inner surface 24 and the outer surface 22. Some examples of sound dampening material suitable for use in the instant invention include, but should not be limited to urethane foam board, DIVINYCELL board, closed cell urethane board and suitable combinations thereof. The inner surface may also include a plurality of holes or slots, as is well known in the art, to provide additional sound suppression.

For causing directional movement of the boat hull 12 the aft fairing 18 includes at least one and preferably two steering vanes 28 pivotally mounted within the aft fairing 18 for movement about generally vertical axes 30 and positioned within the rearward jet of air. The shroud 16 and aft fairing 18 concentrate and direct the jet of air through the exhaust aperture 20 while reducing the noise generated by the rotating propeller 42. Rotational movement of the steering vanes 28 deflect the rearward jet of air to permit directional control of the boat in a conventional manner.

Figure 2:
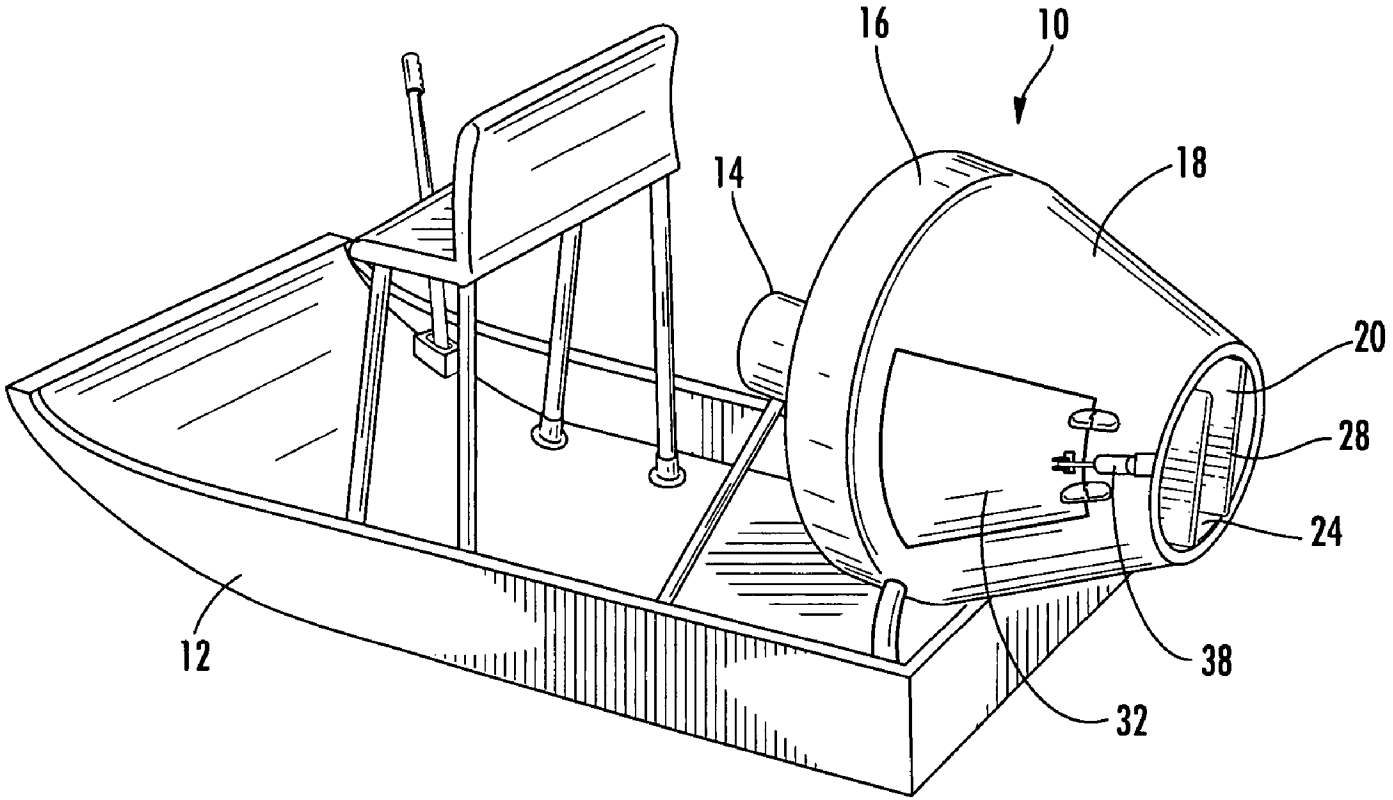
FIG. 2 sets forth a perspective view of an air-boat incorporating an alternative embodiment of the instant invention.
Figure 3:
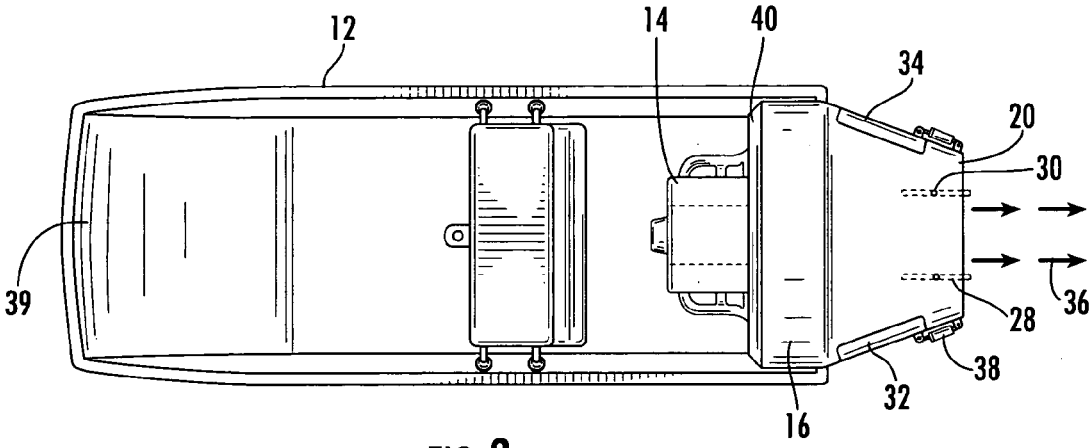
FIG. 3 sets forth a top view of the air-boat shown in FIG. 2, illustrating the clamshell doors in a stowed position and the rearward jet of air discharging through the exhaust aperture of the instant invention.

Referring to FIGS. 2 and 3, an alternative embodiment of the air-boat sound suppressor and directional control system as set forth in FIG. 1 is illustrated. This embodiment includes a first clamshell door 32 and a second clamshell door 34 each pivotally mounted on opposite sides of the longitudinal centerline of the boat hull 12. Linkage 38 is secured between the aft fairing 18 and the clamshell doors 32–34 to allow operator controlled positioning of the clamshell doors throughout a range of positions. For example, the clamshell doors are illustrated in their respective stowed positions in FIG. 1, and their respective deployed positions in FIGS. 4 and 5. The linkage preferably includes cables, gears and levers, but may also include actuators (not shown) such as hydraulics, servo-hydraulics, pneumatics or suitable combinations thereof for power assisted clamshell door movement. The linkage and/or actuators are connected in a manner well known in the art to allow independent as well as similar simultaneous operator controlled positioning of the clamshell doors.

Also shown in FIG. 3 is the forward inwardly extending depending lip 40. The depending lip is constructed and arranged to retain noise generated by the rotating propeller within the shroud 16 and aft fairing 18. In a preferred embodiment the depending lip includes an inner surface 44 an outer surface 46 and a layer of sound dampening material 26 therebetween (FIG. 5).

Figure 4:
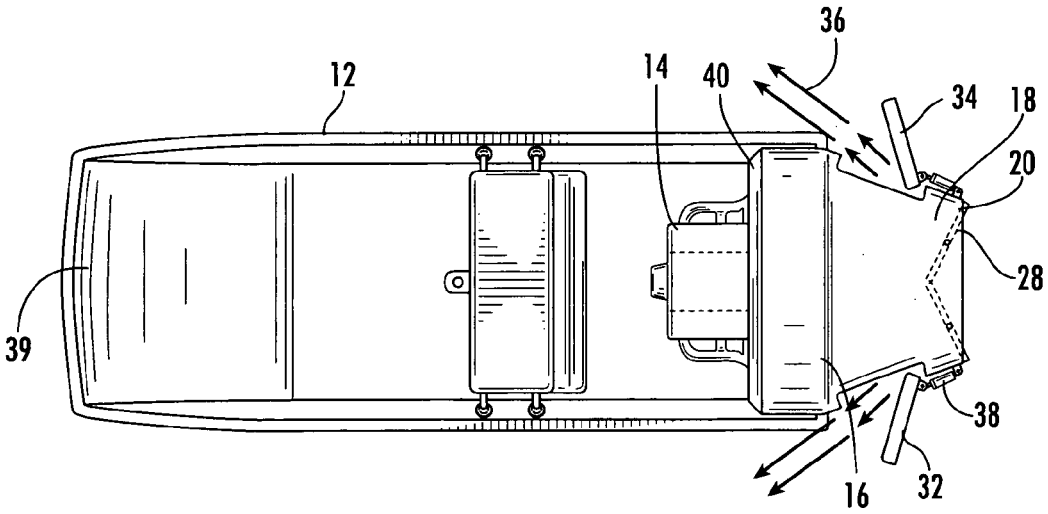
FIG. 4 sets forth a top view of the air-boat shown in FIG. 2, illustrating the clamshell doors in a deployed reverse thrust position and the normally rearward jet of air discharging toward the bow of the air-boat.

Referring to FIG. 4 the clamshell doors 32–34 are illustrated deployed into a reverse thrust position. The diverted jet of air is represented by arrows 36. In the preferred embodiment the steering vanes 28 are pivotable to a position that substantially covers the exhaust aperture 20. In this manner, substantially all of the rearward jet of air is redirected through the clamshell doors 32 and 34. The clamshell doors being positioned to deflect the air jet predominantly toward the bow 39 of the boat hull 12 to create the reverse thrust.

Referring to FIG. 5 the clamshell doors 32–34 are illustrated deployed into turning thrust positions. In this embodiment, either clamshell door may be positioned to deflect the air jet perpendicular to the longitudinal centerline of the boat hull 12. In this manner, substantially all of the rearward jet of air may be redirected through either or both deployed clamshell door(s) 32 or 34 to provide increased turning ability to the air-boat.

Figure 6:
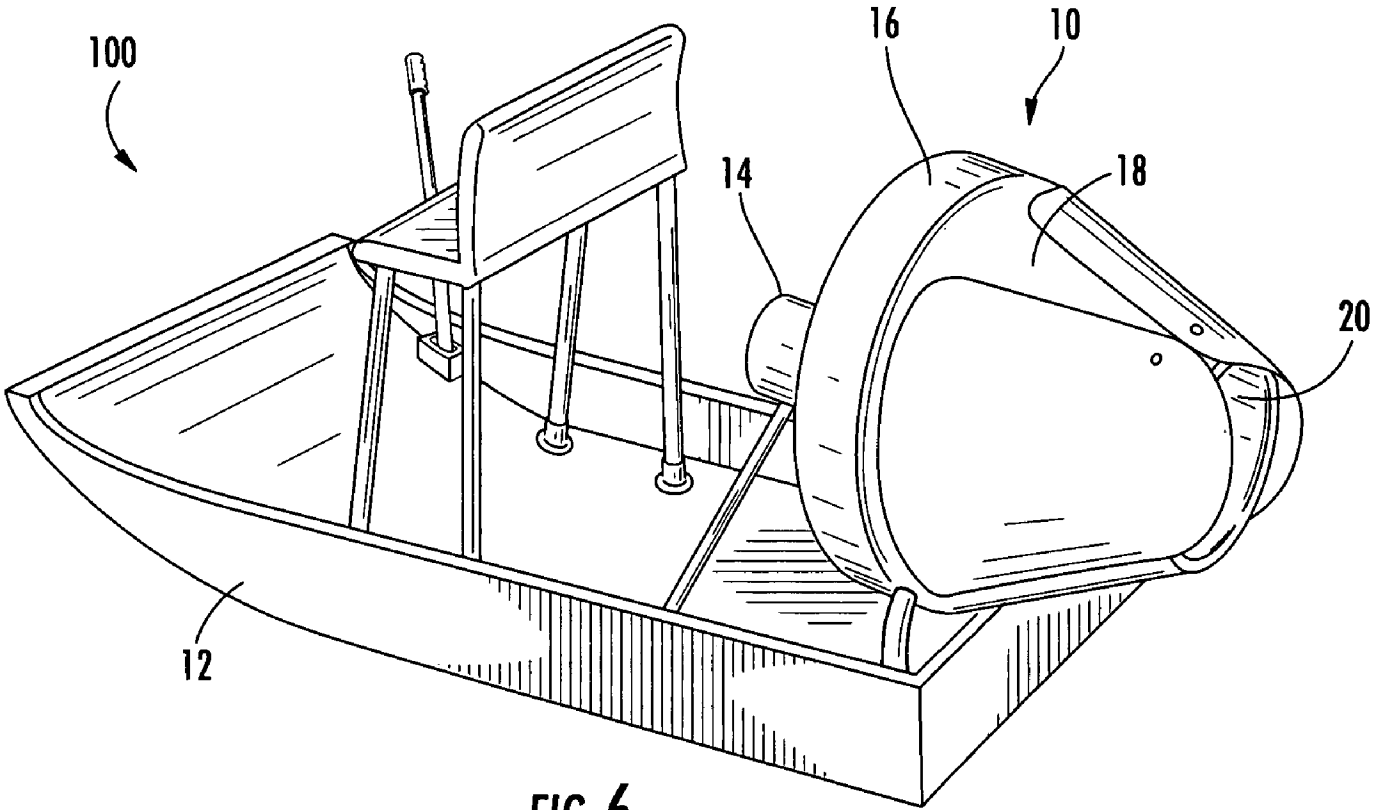
FIG. 6 sets forth a perspective view of an air-boat incorporating an alternative embodiment of the instant invention.
Figure 7:
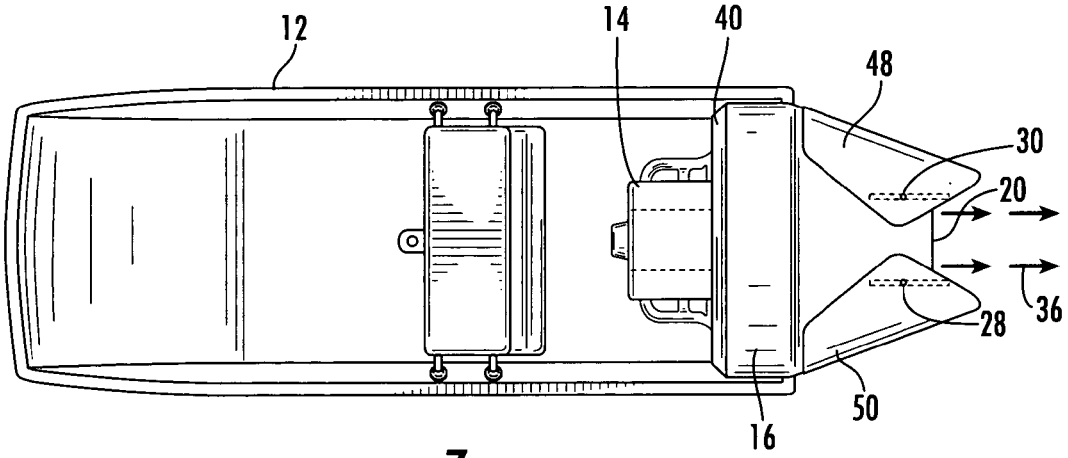
FIG. 7 sets forth a top view of the air-boat shown in FIG. 6, illustrating the clamshell doors in a stowed position and the rearward jet of air discharging through the exhaust aperture of the instant invention.
Figure 8:
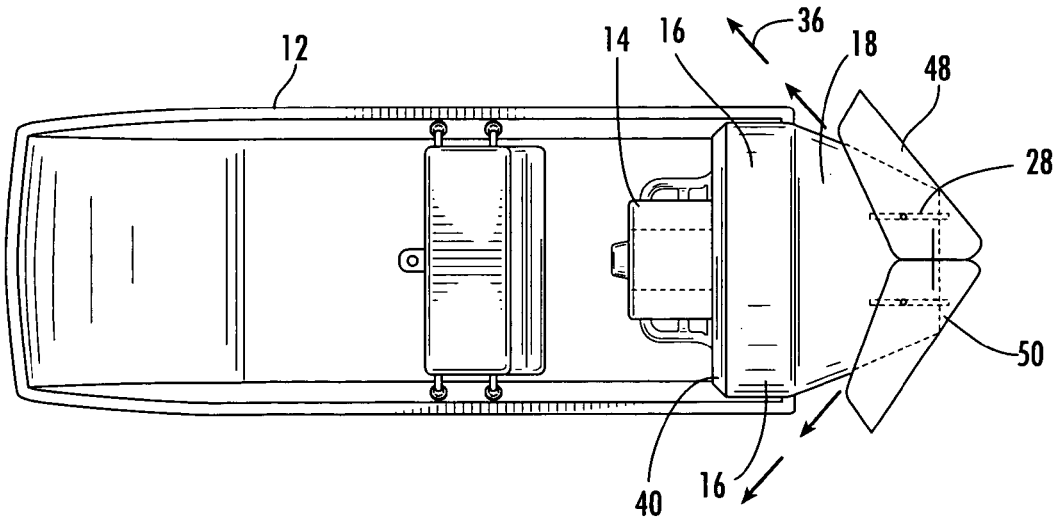
FIG. 8 sets forth a top view of the air-boat shown in FIG. 6, illustrating the clamshell doors in a deployed reverse thrust position and the normally rearward jet of air discharging toward the bow of the air-boat.

Referring to FIGS. 6–8, an alternative embodiment of the air-boat sound suppressor and directional control system as set forth in FIG. 1 is illustrated. In this embodiment the clamshell doors 48 and 50 are constructed and arranged extend rearward of the aft fairing while pivoted to a deployed position. In this manner the clamshell doors catch and deflect the jet of air traveling through exhaust aperture 20 without blocking exhaust aperture 20 with the steering vanes 28. For example, the clamshell doors 48–50 are illustrated in their respective stowed positions in FIGS. 6 and 7, and their respective deployed positions in FIG. 8.

Figure 9:
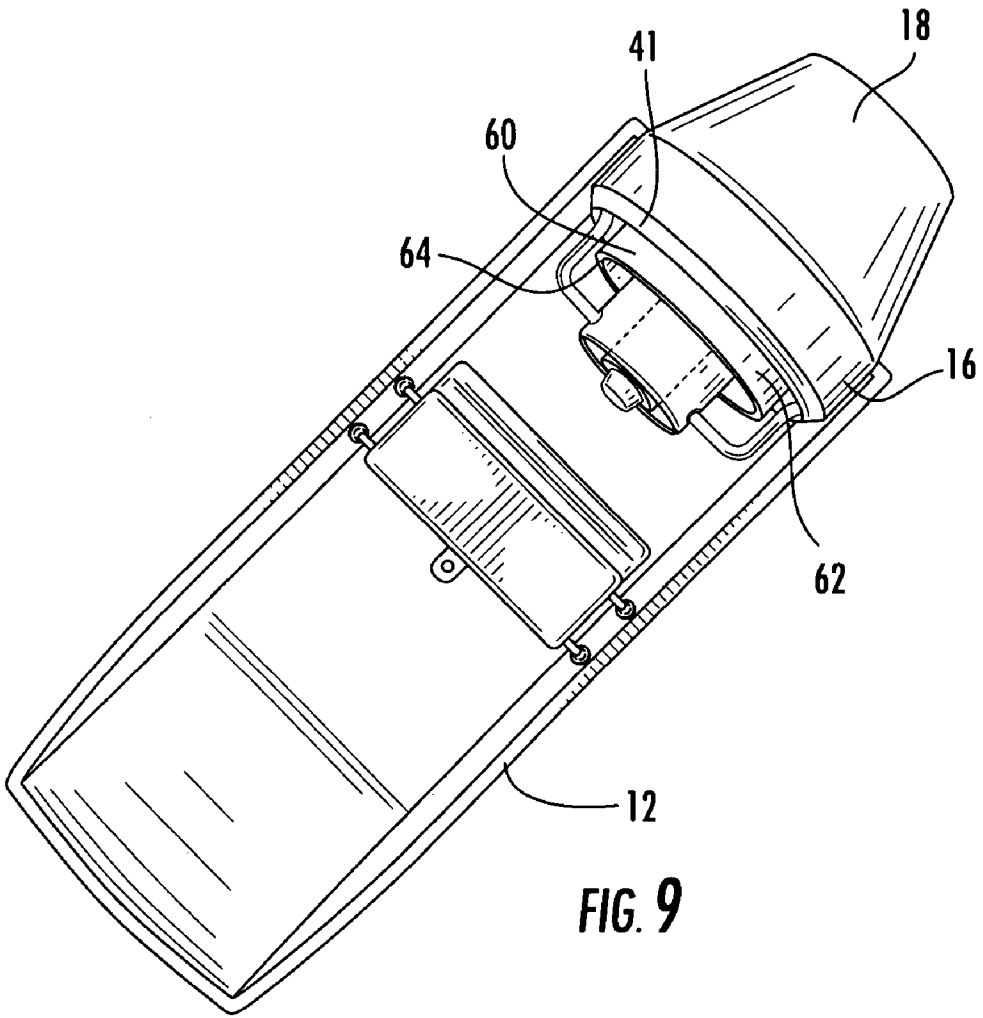
FIG. 9 sets forth a perspective view of an air-boat incorporating an alternative embodiment of the instant invention.

Referring to FIG. 9, an alternative embodiment of the air-boat sound suppressor and directional control system as set forth in FIG. 1 is illustrated. In this embodiment the air opening 41 includes a baffle 60 for directing air into said air opening. The baffle has a substantially conjugate shaped perimeter 62 and a smaller diameter with respect to the air inlet 41. The baffle 60 includes a forward portion 64 extending in outwardly in front of said air inlet and a rearward portion extending into said air inlet. The construction and arrangement of the baffle directs air between the conjugate shaped perimeter and said air inlet aperture in a manner whereby sound is retained within said sound suppressor and directional control system without substantially reducing the efficiency of the device.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

I claim:

1. In combination with a boat hull to be propelled by a rearward discharge of air therefrom and including air jet developing means for discharging a jet of air along a predetermined path, a sound suppressor and directional control system comprising:

a propeller shroud fully encircling a propeller, said shroud including an aft fairing, said aft fairing having an inner surface converging to an exhaust aperture for discharge of said jet of air in a rearward direction, wherein said aft fairing includes a first clamshell door pivotally mounted on a first side of a longitudinal centerline of said boat hull and a second clamshell door pivotally mounted on a second side of said longitudinal centerline, said first and said second clamshell doors each being independently moveable between a stowed position and a deployed position, wherein said rearward jet of air is directed through said exhaust aperture while said first and said second clamshell doors are in said stowed position, wherein a portion of said rearward jet of air is diverted through said first clamshell door when pivoted to said deployed position, wherein a portion of said rearward jet of air is diverted through said second clamshell door when pivoted to said deployed position, whereby either said diverted jet of air defines a vector thrust, whereby said vector thrust is sufficient to cause directional movement of said boat hull, said shroud including a forward inwardly converging lip defining an air inlet for allowing air to enter said sound suppressor and directional control system, at least one steering vane mounted to said aft fairing for pivotal movement about a generally vertical axis and positioned within said reward jet of air;

whereby air enters said air inlet and said propeller shroud and said aft fairing concentrate and direct said jet of air through said exhaust aperture and wherein pivotal movement of said at least one steering vane causes deflection of said jet of air causing directional movement of said boat hull, and wherein sound generated by said air jet developing means is substantially reduced.

2. The air-boat sound suppressor and directional control system as set forth in claim 1 wherein said system includes a pair of steering vanes, wherein said pair of steering vanes are connected for similar simultaneous pivotal displacement;

wherein said propeller shroud and said aft fairing concentrate and direct said jet of air through said exhaust aperture and wherein pivotal movement of said pair of steering vanes deflect said jet of air causing directional movement of said boat hull.

3. The air-boat sound suppressor and directional control system as set forth in claim 1 wherein at least one of said first or said second clamshell doors include a linkage for pivoting said at least one of said first or said second clamshell doors between said stowed position and said deployed position, wherein said linkage is constructed and arranged to provide independent movement of said at least one of said first or said second clamshell doors pivoting between said stowed position and said deployed position.

4. The air-boat sound suppressor and directional control system as set forth in claim 3 wherein said linkage includes a means for connecting said first and said second clamshell doors for similar simultaneous movement.

5. The air-boat sound suppressor and directional control system as set forth in claim 4 wherein said means for connecting said first and said second clamshell doors includes a cable.

6. The air-boat sound suppressor and directional control system as set forth in claim 3 wherein said linkage includes an actuator for power assisted pivoting of said at least one of said first or said second clamshell doors between said stowed position and said deployed position.

7. The air-boat sound suppressor and directional control system as set forth in claim 1 wherein said first clamshell door includes a first linkage for pivoting said first clamshell door between said stowed position and said deployed position, wherein said second clamshell door includes a second linkage for pivoting said second clamshell door between said stowed position and said deployed position, wherein said first and said second linkages are constructed and arranged to provide independent movement of said first and said second clamshell doors pivoting between said stowed position and said deployed position.

8. The air-boat sound suppressor and directional control system as set forth in claim 7 wherein said first linkage includes a first actuator for pivoting said first clamshell door between said stowed position and said deployed position and wherein said second linkage includes a second actuator for pivoting said second clamshell door between said stowed position and said deployed position.

9. The air-boat sound suppressor and directional control system as set forth in claim 8 wherein said first and said second actuators are cables.

10. The air-boat sound suppressor and directional control system as set forth in claim 1 wherein said shroud includes an acoustical material attached to an inner surface thereof.

11. The air-boat sound suppressor and directional control system as set forth in claim 10 wherein said aft fairing includes an acoustical material secured to said inner surface.

12. The air-boat sound suppressor and directional control system as set forth in claim 1 wherein said aft fairing includes an outer surface, wherein a layer of acoustic material is secured between said inner surface and said outer surface.

13. The air-boat sound suppressor and directional control system as set forth in claim 1 wherein said first and said second clamshell doors comprise a pair of semi-circular doors.

14. The air-boat sound suppressor and directional control system as set forth in claim 13 wherein said clamshell doors include an extended rearward portion, wherein said extended rearward portion is constructed and arranged to catch and deflect said rearward jet of air while in said deployed position, wherein said deflected jet of air produces reverse thrust.

15. The air-boat sound suppressor and directional control system as set forth in claim 2 wherein said pair of steering vanes are constructed and arranged to pivot to a position about perpendicular to said longitudinal centerline, wherein said pair of steering vanes substantially cover said exhaust aperture, wherein said rearward jet of air is substantially prevented from exiting through said exhaust aperture and wherein said rearward jet of air is diverted through either or both of said deployed clamshell doors.

16. The air-boat sound suppressor and directional control system as set forth in claim 1 wherein said air inlet includes a baffle for directing air into said air inlet, said baffle having a substantially conjugate shaped perimeter as said air inlet, said baffle having a forward portion and a rearward portion, said forward portion extending in outwardly in front of said air inlet, said rearward portion of said baffle extending into said air inlet, said conjugate shaped perimeter being smaller than said air inlet, whereby air is directed between said conjugate shaped perimeter and said air inlet aperture, whereby sound is retained within said sound suppressor and directional control system.

* * * * *